US011970360B2

(12) United States Patent
Kikuchi

(10) Patent No.: US 11,970,360 B2
(45) Date of Patent: Apr. 30, 2024

(54) SHEET PROCESSING APPARATUS AND CONTROL METHOD THEREFOR

(71) Applicant: KYOCERA Document Solutions Inc., Osaka (JP)

(72) Inventor: Ryota Kikuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 270 days.

(21) Appl. No.: 17/727,271

(22) Filed: Apr. 22, 2022

(65) Prior Publication Data

US 2022/0363501 A1 Nov. 17, 2022

(30) Foreign Application Priority Data

May 12, 2021 (JP) ..... 2021-080815

(51) Int. Cl.
*B65H 45/04* (2006.01)
*B65H 7/20* (2006.01)

(52) U.S. Cl.
CPC ..... *B65H 7/20* (2013.01); *B65H 2801/27* (2013.01)

(58) Field of Classification Search
CPC . B65H 7/02; B65H 7/20; B65H 43/00; B65H 45/04; B65H 45/12; B65H 2801/27; B65H 2511/414; B65H 2511/415; B65H 2511/417; G03G 15/6582; G03G 15/6594; G03G 2215/00877
USPC ..... 270/32; 493/405
See application file for complete search history.

(56) References Cited

U.S. PATENT DOCUMENTS 8,600,287 B2 * 12/2013 Takahashi ..... B65H 45/142 399/407
9,365,386 B2 * 6/2016 Ando ..... B42C 19/02
10,315,881 B2 * 6/2019 Tomimatsu ..... G06F 3/1208

FOREIGN PATENT DOCUMENTS

JP 2012-254571 A 12/2012

* cited by examiner

*Primary Examiner* — Leslie A Nicholson, III
(74) *Attorney, Agent, or Firm* — Stein IP, LLC

(57) ABSTRACT

A sheet processing apparatus includes a plurality of folding devices, a control unit that controls a job involving a folding process, and an input unit that accepts settings for the job from a user. The input unit accepts, from the user, specification of a priority preference out of a plurality of predetermined preferences related to the folding process. The control unit selects, out of the plurality of folding devices, a folding device that can perform the folding process with the settings for the job made by the user as a target folding device. If a plurality of target folding devices are present, then based on the priority preference, the control unit determines, out of the plurality of target folding devices, a folding device with which to perform the folding process.

7 Claims, 4 Drawing Sheets

FIG.3

| FOLDING METHOD / FOLDING DEVICE | 1ST FOLDING DEVICE | 2ND FOLDING DEVICE |
|---|---|---|
| DOUBLE FOLDING | AVAILABLE | AVAILABLE |
| TRIPLE FOLDING | AVAILABLE | UNAVAILABLE |
| Z-FOLDING | AVAILABLE | UNAVAILABLE |
| QUADRUPLE FOLDING | UNAVAILABLE | UNAVAILABLE |

SHEET PROCESSING APPARATUS AND CONTROL METHOD THEREFOR

INCORPORATION BY REFERENCE

This application is based on and claims the benefit of priority from Japanese Patent Application No. 2021-080815 filed on May 12, 2021, the contents of which are hereby incorporated by reference.

BACKGROUND

The present disclosure relates to a sheet processing apparatus and a control method for a sheet processing apparatus.

Sheet processing apparatuses provided with a folding device for folding sheets are known. Known sheet processing apparatuses perform a folding process on sheets having images formed on them.

SUMMARY

According to one aspect of the present disclosure, a sheet processing apparatus includes a plurality of folding devices, a control unit, and an input unit. The plurality of folding devices each perform a folding process to fold a sheet. The control unit controls a job that involves the folding process. The input unit accepts settings for the job from a user. The input unit accepts, from the user, specification of a priority preference out of a plurality of predetermined preferences related to the folding process. The control unit selects, out of the plurality of folding devices, a folding device that can perform the folding process with the settings for the job made by the user as a target folding device. If a plurality of target folding devices are present, then based on the priority preference, the control unit determines, out of the plurality of target folding devices, a folding device with which to perform the folding process in the job.

According to another aspect of the present disclosure, a method of controlling a sheet processing apparatus that includes a plurality of folding devices that each perform a folding process to fold a sheet includes: accepting from a user settings for a job involving the folding process; accepting, from the user, specification of a priority preference out of a plurality of predetermined preferences related to the folding process; selecting, out of the plurality of folding devices, a folding device that can perform the folding process with the settings for the job made by the user as a target folding device: and if a plurality of target folding devices are present, then based on the priority preference, determining, out of the plurality of target folding devices, a folding device with which to perform the folding process in the job.

BRIEF DESCRIPTION OF THE DRAWINGS

FIG. 3 is a diagram explaining different methods of folding that can be used on the multifunction peripheral according to the embodiment.

DETAILED DESCRIPTION

An embodiment of the present disclosure will be described below, with a multifunction peripheral taken as an example.

Figure 1:
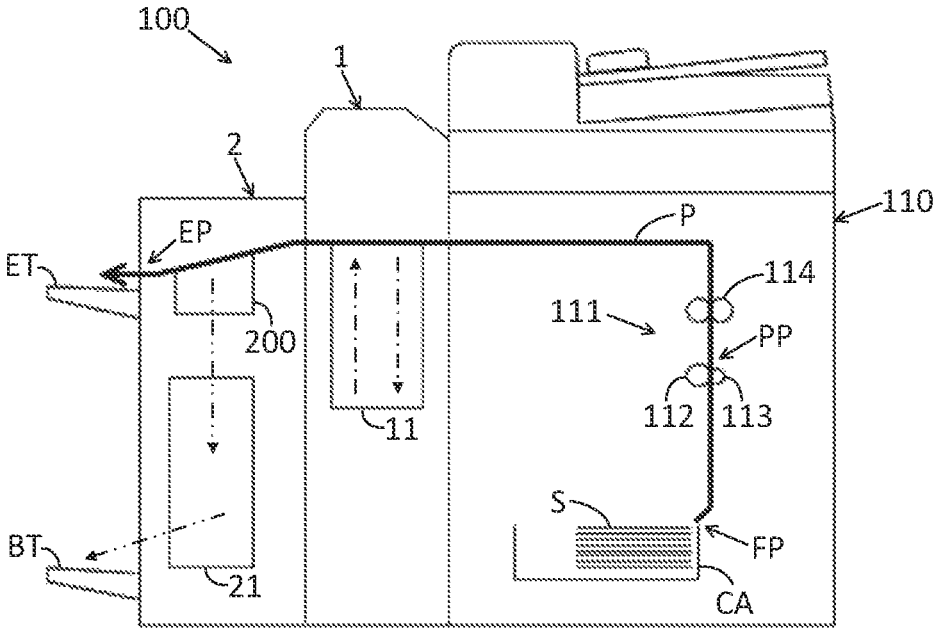
FIG. 1 is a schematic diagram of a multifunction peripheral according to an embodiment.

Construction of a Multifunction Peripheral: As shown in FIG. 1, a multifunction peripheral 100 (corresponding to a "sheet processing apparatus") includes a plurality of folding devices. For example, the multifunction peripheral 100 is provided with two folding devices. In the following description, one folding device is identified by the reference sign "I" and is referred to as the "first folding device 1", and the other folding device is identified by the reference sign "2" and is referred to as the "second folding device 2", The multifunction peripheral 100 also includes, inside a main body 110, a printing unit 111. With the multifunction peripheral 100 seen from in front, the main body 110, the first folding device 1, and the second folding device 2 are disposed in this order from right to left. In a job executed on the multifunction peripheral 100, the printing unit 111 prints an image on a sheet S.

The multifunction peripheral 100 has a sheet conveyance passage P. In FIG. 1, the sheet conveyance passage P is indicated by a thick solid-line arrow. The sheet S is conveyed along the sheet conveyance passage P. and the image is printed on the sheet S that is being conveyed.

The sheet conveyance passage P leads from a sheet feed position FP via the main body 110 (printing unit 111), the first folding device 1, and the second folding device 2 in this order to a sheet discharge position EP. The sheet S is fed into the sheet conveyance passage P at the sheet feed position FP, to be conveyed along the sheet conveyance passage P. That is, the sheet S passes through the main body 110 (printing unit 111), the first folding device 1, and the second folding device 2 in this order. Eventually, the sheet S is discharged out of the sheet conveyance passage P at the sheet discharge position EP.

The printing unit 111 feeds sheets S into the sheet conveyance passage P at the sheet feed position FP. At the sheet feed position FP, a cassette CA is disposed. Inside the cassette CA, sheets S are stored. The sheets S are fed out from the cassette CA.

Though not illustrated, the printing unit 111 includes a sheet feed roller. The sheet feed roller lies in contact with the sheets S in the cassette CA, and rotates in that states. As a result, a sheet S is pulled out of the cassette CA and is fed into the sheet conveyance passage P.

Though not illustrated, the printing unit 111 includes pairs of conveying rollers. The pairs of conveying rollers are disposed along the sheet conveyance passage P. The pairs of conveying rollers rotate and thereby convey sheets S. The number of pairs of conveying rollers provided along the sheet conveyance passage P and their positions can be changed to suit the shape, length, and the like of the sheet conveyance passage P.

The printing unit 111 includes a photosensitive drum 112 and a transfer roller 113. The photosensitive drum 112 and the transfer roller 113 lie in pressed contact with each other. Thus, between the photosensitive drum 112 and the transfer roller 113, a transfer nip is formed. The printing unit 111 has the transfer nip at a printing position PP. The sheet conveyance passage P passes across the printing position PP.

Though not illustrated, the printing unit 111 includes a charging device, an exposure device, and a developing device. The charging device electrostatically charges the circumferential surface of the photosensitive drum 112. The exposure device forms an electrostatic latent image on the circumferential surface of the photosensitive drum 112. The developing device develops the electrostatic latent image into a toner image.

The sheet S being conveyed passes through the transfer nip, and meanwhile the toner image is transferred to the sheet S. The sheet S having the toner image transferred to it continues to be conveyed.

The printing unit 111 includes a pair of fixing rollers 114. The pair of fixing rollers 114 has a fixing nip at a position downstream of the printing position PP in the sheet conveyance direction. The sheet S having the toner image transferred to it passes through the fixing nip. Meanwhile, the pair of fixing rollers 114 heats and presses the sheet S passing through the fixing nip and thereby fixes the toner image to the sheet S.

Thus the printing unit 111 completes a printing process. The printing unit 111 then conveys the printed sheet S toward the first folding device 1. The printing unit 111 carries the printed sheet S into the first folding device 1.

The first folding device 1 performs a folding process to fold the sheet S having the image printed on it by the printing unit 111. Specifically, the first folding device 1 includes a folding unit 11. In the following description, for distinction from the folding unit 21 described later, the folding unit 11 in the first folding device 1 will be referred to as the "first folding unit 11".

The first folding unit 11 can use different methods of folding on the sheet S. This will be described in detail later.

When a folding process is performed in the first folding unit 11, the first folding device 1 diverts the sheet S carried in from the printing unit 111 into the first folding unit 11. In other words, the first folding device 1 diverts the sheet S being conveyed along the sheet conveyance passage P into the first folding unit 11. The first folding unit 11 performs the folding process on the sheet S and then returns the sheet S to the sheet conveyance passage P. After that, the first folding device 1 carries the sheet S into the second folding device 2. The path along which the sheet S is conveyed when a folding process is performed in the first folding unit 11 is indicated by a dash-and-dot-line arrow.

When no folding process is performed in the first folding unit 11, the first folding device 1 conveys the sheet S carried in from the printing unit 111 as it is further along the sheet conveyance passage P. The first folding device 1 then carries the sheet S into the second folding device 2.

The second folding device 2 performs a folding process to fold the sheet S having the image printed on it by the printing unit 111. Specifically, the second folding device 2 includes a folding unit 21. In the following description, the folding unit 21 in the second folding device 2 will be referred to as the "second folding unit 21".

The second folding device 2 has a function of producing a middle-bound booklet. Specifically, the second folding device 2 includes a stapling unit 200 that binds a bundle of sheets S with a staple. The second folding unit 21 can perform as a folding process at least a process of folding sheets S in the middle (double folding). This will be described in detail later.

The second folding device 2 carries in the sheet S from the first folding device 1. For example, not both of the first and second folding units 11 and 21 perform a folding process at one time. That is, when the first folding unit 11 performs a folding process, the second folding unit 21 performs no folding process; when the first folding unit 11 performs no folding process, the second folding device 21 performs a folding process. The first and second folding units 11 and 12 can both not perform a folding process.

When a folding process is performed in the second folding unit 21, the second folding device 2 diverts the sheet S carried in from the first folding device 1 into the second folding unit 21. In other words, the second folding device 2 diverts the sheet S being conveyed along the sheet conveyance passage P into the second folding unit 21. The second folding unit 21 then performs a folding process on the sheet S.

Here, the second folding device 2 includes discharge trays ET and BT. The discharge tray ET is disposed at the sheet discharge position EP. That is, the sheet conveyance passage P leads to the discharge tray ET. The discharge tray BT is a tray for a booklet, and is used when the second folding unit 21 performs a folding process. In the following description, the discharge tray BT will be referred to as the "booklet tray BT" for distinction from the discharge tray ET.

When no folding process is performed in the second folding unit 21, the second folding device 2 conveys the sheet S carried in from the first folding device 1 as it is further along the sheet conveyance passage P. The second folding device 2 then discharges the sheet S onto the discharge tray ET.

By contrast, when a folding process is performed in the second folding unit 21, the sheet S is discharged onto the booklet tray BT. Specifically, after performing the folding process on the sheet S, the second folding unit 21 does not return the sheet S to the sheet conveyance passage P but discharges it onto the booklet tray BT. The sheet S having undergone the folding process by the second folding unit 21 is discharged from the second folding unit 21 directly onto the booklet tray BT. The path along which the sheet S is conveyed when the second folding unit 21 performs a folding process is indicated by a dash-dot-dot-line arrow.

Figure 2:
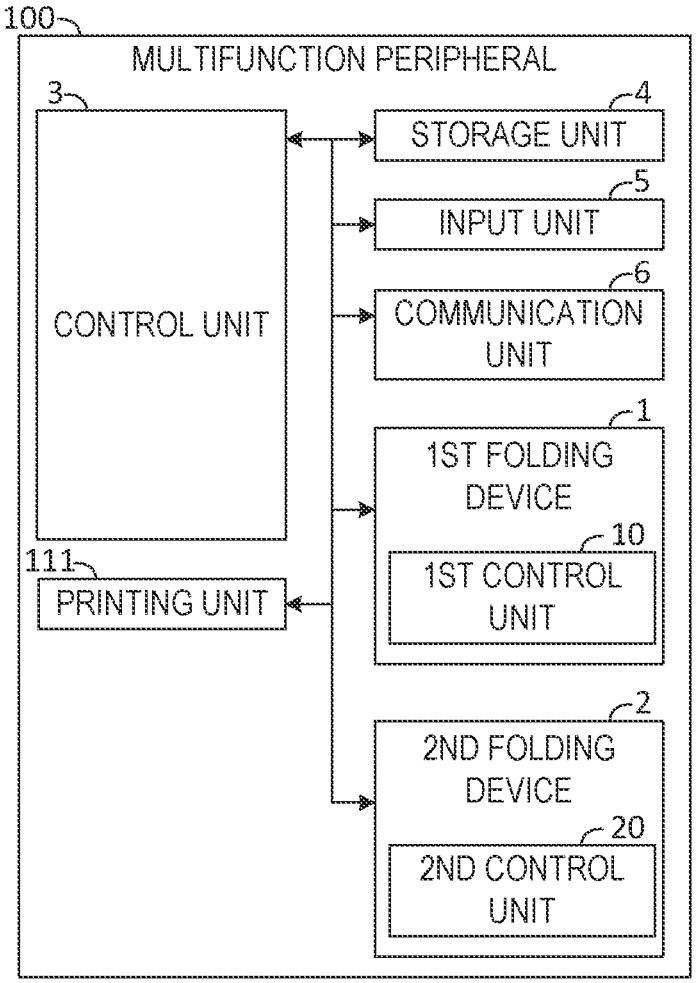
FIG. 2 is a block diagram of the multifunction peripheral according to the embodiment.

As shown in FIG. 2, the multifunction peripheral 100 includes a control unit 3. The control unit 3 includes a processing circuit such as a CPU. The control unit 3 controls the multifunction peripheral 100. The control unit 3 also performs various processes including image processing on image data.

The control unit 3 controls the printing unit 111. The control unit 3 also controls the first and second folding devices 1 and 2.

The multifunction peripheral 100 includes a storage unit 4. The storage unit 4 includes a storage device such as a ROM and a RAM. The storage unit 4 is connected to the control unit 3. The control unit 3 reads information from the storage unit 4. The control unit 3 also writes information to the storage unit 4.

The multifunction peripheral 100 includes an input unit 5. The input unit 5 is, for example, an operation panel. The input unit 5 has a touch screen as a display panel. The touch screen displays software buttons, messages, and the like, and accepts touch operations from the user. The input unit 5 also has a Start button to receive an instruction to execute a job from the user.

Prior to the execution of a job, the input unit 5 accepts settings for the job from the user. The user can specify sheet size, the number of copies to be made, and the like. The user can also make a setting as to whether to perform a folding process in a job, a setting as to what method of folding to use if one is to be used, and the like. Further, while details will be given later, the user can make a setting as to a priority preference.

The multifunction peripheral 100 includes a communication unit 6. The communication unit 6 includes a communication circuit and the like. The communication unit 6 is connected across a network to an external device (not illustrated) so that communication is possible between them. The external device can be a user terminal. A user terminal is a personal computer that is used by the user. For example, from the user terminal to the multifunction peripheral 100, print data for a job (e.g., PDL data) can be transmitted. In that case, settings for the job to be made by the user can be made on the user terminal. That is, the user terminal functions as the input unit.

The first folding device 1 includes a first control unit 10. The first control unit 10 includes a CPU, a memory, and the like. The first control unit 10 is connected to the control unit 3. The control unit 3 gives the first control unit 10 a control instruction as to a folding process in the first folding unit 11. Based on the control instruction from the control unit 3, the first control unit 10 controls the first folding device 1.

The second folding device 2 includes a second control unit 20. The second control unit 20 includes a CPU, a memory, and the like. The second control unit 20 is connected to the control unit 3. The control unit 3 gives the second control unit 20 a control instruction as to a folding process in the second folding unit 21. Based on the control instruction from the control unit 3, the second control unit 20 controls the second folding device 2.

Methods of Sheet Folding: There are various methods of sheet folding, examples including double folding (middle folding), triple folding, Z-folding, and quadruple folding.

The first and second folding devices 1 and 2 each perform a folding process to fold a sheet S by a prescribed method. With reference to FIG. 3, the folding processes that the first and second folding devices 1 and 2 perform will be described below.

The method of folding that can be used (is available) in the folding process on the first folding device 1 is, for example, double folding, triple folding, or Z-folding. The first folding device 1 cannot perform quadruple folding in the folding process. For example, the first folding device 1 can perform double folding on a plurality of (several) sheets S stacked over each other. The first folding device 1 may be able to perform quadruple folding in the folding process. The first folding device 1 may not be able to perform any of the types of folding mentioned above.

The method of folding that can be used (is available) in the folding process on the second folding device 2 is, for example, double folding. The second folding device 2 cannot perform triple folding, Z-folding, or quadruple folding in the folding process. For example, the second folding device 2 can perform double folding on a plurality of (several tens of) sheets S stacked over each other. The second folding device 2 may be able to perform any of triple folding, Z-folding, and quadruple folding.

For example, the sheet size that the first folding device 1 can perform a folding process on is A4R size (A4 size in landscape orientation as seen from in front of the apparatus) and A3 size. The sheet size that the second folding device 2 can perform a folding process on is A4R size. Neither of the first and second folding devices 1 and 2 can perform a folding process on a sheet S of A4E size (A4 size in portrait orientation as seen from in front the apparatus).

Incidentally, in a job that does not involve a folding process, sheets S of A4E size can be used. Accordingly, the sheet size to be used in a job can be set to A4E size. Even in a job that involves a folding process, the sheet size an be set to A4E size. In that case, however, the job is not executed and instead an alternative means is indicated.

Accepting Settings for a Folding Process: The input unit 5 accepts settings for a job involving a folding process from the user; it accepts, as settings for a job involving a folding process, settings as to sheet size, the number of copies to be printed, image quality (e.g., density), and the folding process to be employed, and the like.

Among settings related to the folding process, a setting can be made as to the number of stacked sheets to be folded, and also a setting as to the method of folding. For example, when double folding is desired on three sheets stacked on each other, the number of stacked sheets to be folded can be set to "3" and the method of folding to "double folding".

The input unit 5 also accepts, from the user, specification of a priority preference out of a plurality of predetermined preferences related to a folding process. In other words, the input unit 5 accepts, out of the respective features of a plurality of folding devices, a selected feature as a user-specified feature (priority preference). The plurality of predetermined preferences (preferences of which any can be specified as a priority preference) are prescribed by the manufacturer based on the respective features of the first and second folding devices 1 and 2.

For example, the first folding device 1 has the feature of a higher processing speed in the folding process than the second folding device 2. Specifically, double folding on a sheet S can be performed with either of the first and second folding devices 1 and 2. However, the time required to perform double folding on one sheet S and discharge it is shorter with the first folding device 1 than with the second folding device 2.

For another example, double folding on a bundle of a plurality of sheets S can be performed with either of the first and second folding devices 1 and 2. If the folding process is performed with the first folding device 1, the double-folded bundle of sheets S is returned from the first folding unit 11 to the sheet conveyance passage P and is then conveyed along the sheet conveyance passage P to be discharged onto the discharge tray ET. If the folding process is performed with the second folding device 2, the double-folded bundle of sheets S is discharged from the second folding unit 21 directly onto the booklet tray BT.

If the folding process is performed with the first folding device 1, while the bundle of sheets S is being conveyed, the bundle of sheets S being conveyed is prone to loosen. That is, the output tends to have an untidy finish.

By contrast, if the folding process is performed with the second folding device 2, the bundle of sheets S is discharged from the second folding unit 21 directly to the booklet tray BT, and this helps suppress an untidy finish of the output. That is, the second folding device 2 has the feature of a tidier finish of the output than the first folding device 1.

In a configuration where the first and second folding devices 1 and 2 have the above-mentioned features respectively, to a user who gives priority to completing a job promptly it is preferable to recommend the use of the first folding device 1. In a configuration where the first and second folding devices 1 and 2 have the above-mentioned features respectively, to a user who gives priority to obtaining a tidily-finished output it is preferable to recommend the use of the second folding device 2.

Accordingly, in a configuration where the first and second folding devices 1 and 2 have the above-mentioned features respectively, a predetermined preference "speed-prioritized" is included among specifiable candidates. Likewise, in a configuration where the first and second folding devices 1 and 2 have the above-mentioned features respectively, a predetermined preference "finish-prioritized" is included among specifiable candidates. For example, buttons marked "speed-prioritized" and "finish-prioritized" are displayed on the input unit 5 so as to be alternatively selectable.

If either of the first and second folding devices 1 and 2 further has another feature different from any mentioned above, a predetermined preference corresponding to that feature is added to the specified candidates. If a folding device (not illustrated) that has a feature different from any mentioned above, based on the feature of that folding device, a candidate is determined that can be specified as a priority preference.

<Procedure of Operation>

Figure 4:
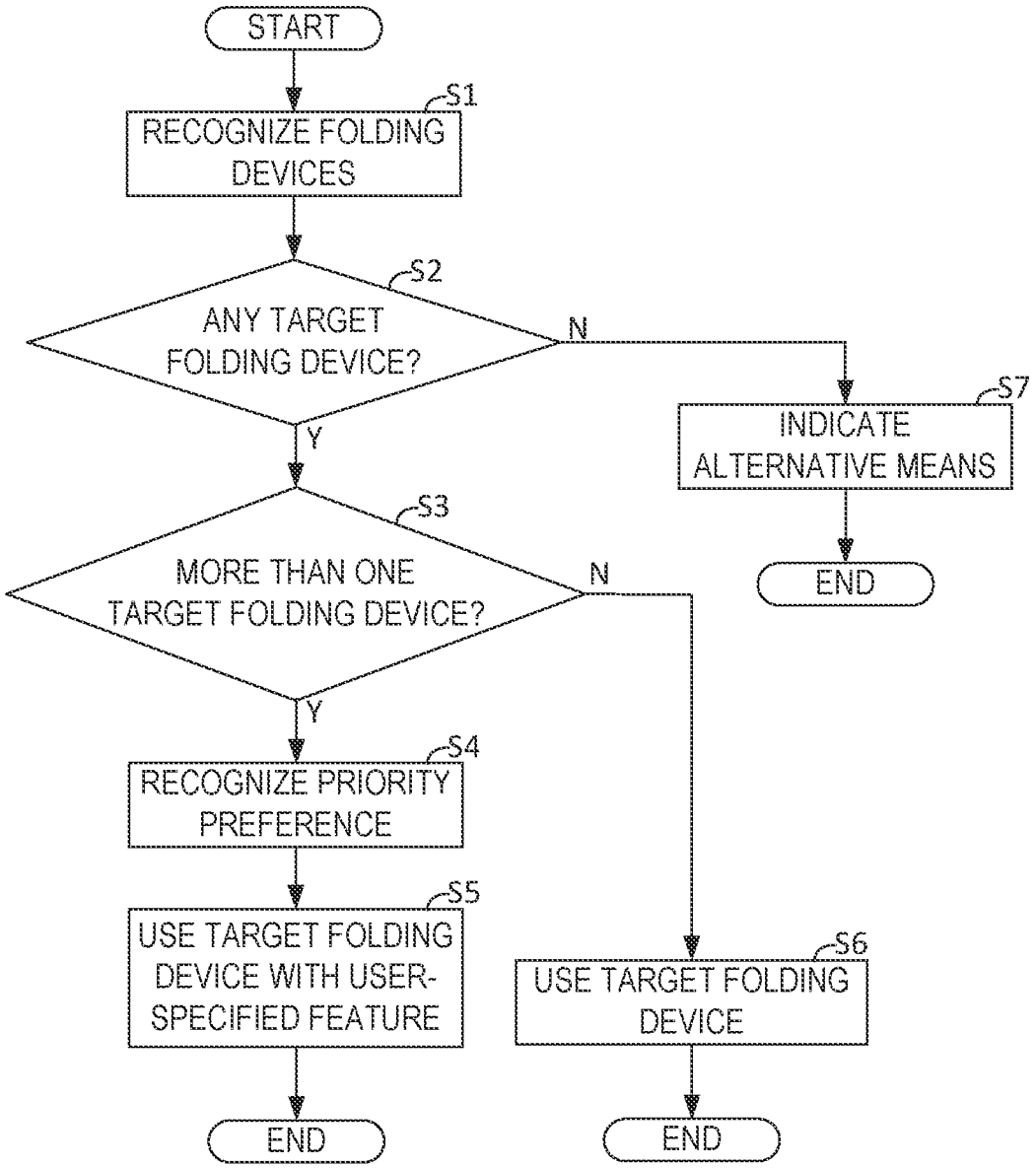
FIG. 4 is a flow chart of a procedure of operation that is performed by a control unit in the multifunction peripheral according to the embodiment.

Now, with reference to the flow chart shown in FIG. 4, the procedure of operation that the control unit 3 performs when executing a job involving a folding process will be described. The procedure shown in FIG. 4 starts when the input unit 5 accepts an instruction to execute a job involving a folding process.

At step S1, the control unit 3 recognizes any folding device attached to the multifunction peripheral 100. Specifically, the control unit 3 communicates with the first control unit 10 to recognize that the first folding device 1 is attached. Likewise, the control unit 3 communicates with the second control unit 20 to recognize that the second folding device 2 is attached.

At step S2, the control unit 3 recognizes the settings for the job (including settings for the folding process) made by the user. The control unit 3 then check whether any folding device is present that can perform the folding process according to the settings for the job made by the user (whether the job set by the user can be performed). In other words, the control unit 3 checks whether a sheet S can be folded by the user-specified method of folding.

Incidentally, the control unit 3 recognizes as a target folding device the folding device that can perform the folding process according to the settings for the job made by the user (the folding device that can fold the sheet S by the user-specified method of folding). That is, at step S2, a judgment of whether a target folding device is present is made by the control unit 3.

If at step S2 the control unit 3 judges that a target folding device is present, the procedure proceeds to step S3. In other words, if the control unit 3 judges that either of the first and second folding devices 1 and 2 can fold the sheet S by the user-specified method of folding, the procedure proceeds to step S3. If the first and second folding devices 1 and 2 can both fold the sheet S by the user-specified method of folding, the procedure proceeds to step S3. Also if only either the first or second folding device 1 or 2 can fold the sheet S by the user-specified method of folding, the procedure proceeds to step S3.

At step S3, the control unit 3 checks whether a plurality of target folding devices are present. If the control unit 3 judges that a plurality of target folding devices are present that can fold the sheet S by the user-specified method of folding, the procedure proceeds to step S4. That is, if the control unit 3 judges that the first and second folding devices 1 and 2 can both fold the sheet S by the user-specified method of folding, the procedure proceeds to step S4. For example, if the user-specified method of folding is double folding, the procedure proceeds to S4.

At step S4, the control unit 3 recognizes a user-specified priority preference. Specifically, the control unit 3 recognizes a predetermined preference that matters to the user (i.e., a preference to which the user wants to give priority) in the job involving the folding process. For example, either "speed-prioritized" or "finish-prioritized" is specified as a priority preference by the user beforehand.

At step S5, based on the user-specified priority preference, the control unit 3 determines, out of the plurality of target folding devices (first and second folding devices 1 and 2), the folding device with which to perform the folding process in the job. In other words, based on the feature selected by the user out of the respective features of the plurality of target folding devices, the control unit 3 determines, out of the plurality of target folding devices, the folding device with which to perform the folding process in the job. Specifically, the control unit 3 makes, out of the plurality of target folding devices, the folding device that has the feature selected by the user perform the folding process (the control unit 3 uses in the job the folding device that has the user-specified feature).

For example, if the user-specified priority preference is "speed-prioritized", the control unit 3 makes the first folding device 1 perform the folding process in the job. In other words, if the user selects the feature of a higher processing speed, the control unit 3 makes the folding device that offers a higher processing speed in the folding process (the corresponding folding device being the first folding device 1) perform the folding process in the job.

For another example, if the user-specified priority preference is "finish-prioritized", the control unit 3 makes the second folding device 2 perform the folding process in the job. In other words, if the user selects the feature of a tidier finish of the output, the control unit 3 makes the folding device that offers a tidier finish of the output (the corresponding folding device being the second folding device 2) perform the folding process in the job.

Incidentally, even in a case where the number of stacked sheets to be folded is set to "one", that is, in a case where no stacking of a plurality of sheets S is involved, if the user-specified priority preference is "finish-prioritized", the second folding device 2 performs the folding process in the job. This, however, is not meant as any limitation. In a case where the user-specified priority preference is "finish-prioritized" and in addition the number of stacked sheets to be folded is set to "one", the first folding device 1 may perform the folding process in the job.

If at step S3 the control unit 3 judges that only one target folding device is present, the procedure proceeds to step S6. At step S6, the control unit 3 makes the target folding device perform the folding process in the job irrespective of the user-specified priority preference (the user-specified feature) (the control unit 3 uses the target folding device in the job).

For example, suppose that the user-specified method of folding is Z-folding. The first folding device 1 can perform Z-folding, whereas the second folding device 2 cannot perform Z-folding. Accordingly, if the user-specified method of folding is Z-folding, the procedure proceeds from step S3 to step S6. The control unit 3 then makes the first folding device 1 perform the folding process in the job. Even if the user-specified priority preference is "finish-prioritized", the first folding device 1 performs the folding process in the job.

If at step S2 the control unit 3 judges that no target folding device is present, the procedure proceeds to step S7. For example, suppose that the sheet size is set to "A4E size" and the folding process (method of folding the sheet S) is set to "double folding". The first and second folding devices 1 and 2 can both perform double folding. However, neither of the first and second folding devices 1 and 2 can perform a folding process on a sheet S of A4E size. Accordingly, in this case, the procedure proceeds from step S2 to step S7.

At step S7, the control unit 3 performs a process of indicating an alternative means. Specifically, the control unit 3 sets, out of the plurality of folding devices, a folding device that has the user-specified feature (selected feature) as a recommended folding device. The control unit 3 also recognizes a sheet size that can be handled by the recommended folding device as an alternative size. The control unit 3 then makes the input unit 5 perform the indicating process.

The input unit 5 indicates that changing the sheet size to be used in the job involving the folding process to the alternative size will make it possible to perform the job. For example, though not illustrated, the input unit 5 displays size information indicating the alternative size, and displays an indication message to indicate that changing to the alternative size will make it possible to execute the job.

For example, if the user-specified priority preference is "speed-prioritized", that is, if the user selects the feature of a higher processing speed in a folding process, the first folding device 1 is set as the recommended folding device. The first folding device 1 can perform a folding process on A4R and A3 sizes. Accordingly, in this example, A4R and A3 sizes are alternative sizes.

For another example, if the user-specified priority preference is "finish-prioritized", that is, if the user selects the feature of a tidy finish of the output, the second folding device 2 is set as the recommended folding device. The second folding device 2 can perform a folding process on A4R size. Accordingly, in this example, only A4R size is an alternative size.

For example, the input unit 5, while performing the indicating process, accepts whether to change to an alternative size. Though not illustrated, together with the indication message, there are displayed on the input unit 5 a Change button for accepting from the user an instruction to change to an alternative size and a Cancel button for accepting from the user an instruction not to change to an alternative size (an instruction to cancel the job).

If the input unit 5 accepts an instruction to change to an alternative size (an operation on the Change button), the control unit 3 changes the sheet size that is set to be used in the job involving the folding process to the alternative size. The control unit 3 then starts the job involving the folding process. In this case, the control unit 3 makes the recommended folding device perform the folding process.

If the input unit 5 accepts an instruction not to change to an alternative size (an operation on the Change button), the control unit 3 does not start the job involving the folding process. For example, a message indicating that there is an error in the settings for the job can be displayed on the input unit 5.

With the configuration according to the embodiment, as described above, the input unit 5 accepts, from the user, specification of a priority preference out of a plurality of predetermined preferences related to a folding process on a sheet S. Then, if a plurality of target folding devices are present that can perform the folding process with the settings for a job made by the user, based on the user-specified priority preference, the control unit 3 determines the target folding device with which to perform the folding process in the job. This configuration is convenient to the user because, without the user looking up the respective features of a plurality of folding devices (first and second folding devices 1 and 2), settings are automatically made so that the folding process will be performed with the folding device that corresponds to the predetermined preference that matters to the user (i.e., the priority preference). This is particularly convenient to a user who is not accustomed to using the multifunction peripheral 100.

Moreover, with the configuration according to the embodiment, as described above, the input unit 5 accepts, out of the respective features of the plurality of folding devices, the selected feature as the user-specified priority preference. With this configuration, when specifying the priority preference, the user has simply to select, out of the respective features of the folding devices, the feature that matters to the user, and this helps further enhance convenience to the user. Specifically, when specifying the priority preference, the user has simply to select a feature that matches the predetermined preference that matters to the user.

Moreover, with the configuration according to the embodiment, as described above, if no target folding device is present, the control unit 3 makes the input unit 5 perform an indicating process. This is convenient to the user, permitting the user to readily know an alternative means.

Moreover, with the configuration according to the embodiment, as described above, the input unit 5, while performing the indicating process, accepts from the user whether to change to an alternative size. If the input unit 5 accepts an instruction to change to the alternative size, the control unit 3 changes the sheet size that is set to be used in the job to the alternative size and makes the recommended folding device perform the folding process. By contrast, if the input unit 5 accepts an instruction not to change to the alternative size, the control unit 3 does not perform the job. With this configuration, it is possible to prevent a job from being executed with a sheet size that is not intended by the user.

Moreover, with the configuration according to the embodiment, as described above, if only one target folding device is present, the control unit 3 makes the target folding device perform the folding process irrespective of the user-specified priority preference. This helps suppress the inconvenience of a job failing to be executed because of a mismatch of the target folding device with the user-specified priority preference.

It should be understood that the embodiment disclosed herein is in every aspect illustrative and no restrictive. The scope of the present disclosure is defined not by the description of the embodiment given above but by the appended claims, and encompasses any modifications made without departure from the scope and sense equivalent to those claims.

What is claimed is:

1. A sheet processing apparatus, comprising:

a plurality of folding devices that each perform a folding process to fold a sheet;

a control unit that controls a job involving the folding process; and an input unit that accepts a setting for the job from a user, wherein the input unit accepts, from the user, specification of a priority preference out of a plurality of predetermined preferences related to the folding process;

the control unit selects, out of the plurality of folding devices, a folding device that can perform the folding process with the setting for the job made by the user as a target folding device, and if a plurality of target folding devices are present, then based on the priority preference, the control unit determines, out of the plurality of target folding devices, a folding device with which to perform the folding process in the job.

2. The sheet processing apparatus according to claim 1, wherein the input unit accepts, out of respective features of the plurality of folding devices, a selected feature as the priority preference, and if a plurality of target folding devices are present, the control unit makes the target folding device that has the selected feature perform the folding process.

3. The sheet processing apparatus according to claim 2, wherein the input unit accepts, as the setting for the job, a setting as to a sheet size to be used in the job, and if no target folding device is present, the control unit sets, out of the plurality of folding devices, the folding device that has the selected feature as a recommended folding device, recognizes a sheet size that the recommended folding device can handle as an alternative size, and makes the input unit perform an indicating process to indicate that changing the sheet size to be used in the job to the alternative size will make it possible to perform the job.

4. The sheet processing apparatus according to claim 3, wherein the input unit, while performing the indicating process, accepts whether to change to the alternative size, if the input unit accepts an instruction to change to the alternative size, the control unit changes the setting as to the sheet size to be used in the job to the alternative size and makes the recommended folding device perform the folding process, and if the input unit accepts an instruction not to change to the alternative size, the control unit does not perform the job.

5. The sheet processing apparatus according to claim 1, wherein if only one target folding device is present, the control unit makes the target folding device perform the folding process.

6. The sheet processing apparatus according to claim 1, further comprising a printing unit, wherein the plurality of folding devices perform the folding process on a sheet having an image printed thereon by the printing unit.

7. A method of controlling a sheet processing apparatus including a plurality of folding devices that each perform a folding process to fold a sheet, the method comprising:

accepting from a user a setting for a job involving the folding process;

accepting, from the user, specification of a priority preference out of a plurality of predetermined preferences related to the folding process;

selecting, out of the plurality of folding devices, a folding device that can perform the folding process with the setting for the job made by the user as a target folding device; and if a plurality of target folding devices are present, then based on the priority preference, determining, out of the plurality of target folding devices, a folding device with which to perform the folding process in the job.

* * * * *